US007739824B1

(12) United States Patent
Swan

(10) Patent No.: US 7,739,824 B1
(45) Date of Patent: Jun. 22, 2010

(54) QUICK DETACH MOUNT WITH LATCHING ASSEMBLY

(76) Inventor: Richard E. Swan, 171 West St., E. Bridgewater, MA (US) 02333

( * ) Notice: Subject to any disclaimer, the term of this patent is extended or adjusted under 35 U.S.C. 154(b) by 212 days.

(21) Appl. No.: 12/062,647

(22) Filed: Apr. 4, 2008

Related U.S. Application Data

(60) Provisional application No. 60/909,956, filed on Apr. 4, 2007.

(51) Int. Cl.
*F41C 23/00* (2006.01)

(52) U.S. Cl. ..... 42/124; 42/71.01; 42/146; 42/148; 42/90; 42/85

(58) Field of Classification Search ..... 42/1.01, 42/124, 148, 90, 146, 85
See application file for complete search history.

(56) References Cited

U.S. PATENT DOCUMENTS

| | | | |
|---|---|---|---|
| 1,428,655 | A | 9/1922 | Noske |
| 2,161,051 | A | 6/1939 | Humeston |
| 2,436,948 | A | 3/1948 | Williams |
| 2,790,241 | A | 4/1957 | Dickenson |
| 2,810,963 | A | 10/1957 | Harper |
| 3,276,377 | A | 10/1966 | Bell |
| 3,877,166 | A | 4/1975 | Ward |
| 4,027,414 | A | 6/1977 | Felix |
| 4,085,511 | A | 4/1978 | Kovac |
| 4,249,315 | A | 2/1981 | Hopson, III |
| 4,310,980 | A | 1/1982 | Pilkington |
| 4,722,496 | A | 2/1988 | Herrmann et al. |
| 4,845,871 | A | 7/1989 | Swan |
| 4,860,480 | A | 8/1989 | Ruger |
| 4,905,396 | A | 3/1990 | Bechtel |
| 4,934,085 | A | 6/1990 | Lough |
| 5,142,806 | A | 9/1992 | Swan |
| 5,155,915 | A | 10/1992 | Repa |
| 5,276,988 | A | 1/1994 | Swan |
| 5,375,361 | A | 12/1994 | Rustick |
| 5,533,292 | A | 7/1996 | Swan |
| 5,590,484 | A | 1/1997 | Mooney et al. |
| 5,606,818 | A | 3/1997 | Hardee |

(Continued)

FOREIGN PATENT DOCUMENTS

| | | | |
|---|---|---|---|
| DE | 2006011542 | U | 12/2006 |

OTHER PUBLICATIONS

A.R.M.S. #19 Dovetail/Stanag Throw Lever Scope Mount, www.mountsplus.com/miva/merchant.mvc?page=MSP/PROD.

(Continued)

*Primary Examiner*—J. Woodrow Eldred
(74) *Attorney, Agent, or Firm*—Barlow, Josephs & Holmes, Ltd.

(57) ABSTRACT

A mounting assembly for attaching an accessory to a dovetail rail interface comprising a mount body, a boss formation extending from a side of the mount body, and a clamping assembly received within the boss formation. The clamping assembly including a camming foot and an actuator arm affixed to the camming foot where rotation of the actuator arm causes rotation of the camming foot. The clamping assembly is movable between an engaged position and a disengaged position. The mounting assembly further includes a spring biased latching assembly configured and arranged to selectively retain said clamping assembly in said engaged position.

11 Claims, 8 Drawing Sheets

U.S. PATENT DOCUMENTS

| | | | | |
|---|---|---|---|---|
| 5,669,173 | A | 9/1997 | Rodney, Jr. | |
| 5,680,725 | A | 10/1997 | Bell | |
| 5,694,712 | A | 12/1997 | Plonka | |
| 6,295,754 | B1 | 10/2001 | Otteman et al. | |
| 6,363,648 | B1 | 4/2002 | Kranich et al. | |
| 6,442,883 | B1 | 9/2002 | Waterman et al. | |
| 6,449,893 | B2 | 9/2002 | Spinner | |
| 6,490,822 | B1 | 12/2002 | Swan | |
| 6,513,276 | B2 | 2/2003 | Mendoza-Orozco | |
| 6,598,330 | B2 | 7/2003 | Garrett et al. | |
| 6,598,333 | B1 | 7/2003 | Randazzo et al. | |
| 6,629,381 | B1 | 10/2003 | Keng | |
| 6,922,934 | B1 | 8/2005 | Huan | |
| 6,931,778 | B1 | 8/2005 | Nelson et al. | |
| 7,272,904 | B2 | 9/2007 | Larue | |
| 7,493,721 | B2 * | 2/2009 | Swan | 42/125 |
| 7,562,485 | B2 * | 7/2009 | Newhall et al. | 42/127 |
| 2004/0000083 | A1 | 1/2004 | Grant, Jr. | |
| 2004/0148842 | A1 | 8/2004 | Aalto et al. | |
| 2006/0162227 | A1 | 7/2006 | Samson | |
| 2006/0207156 | A1 | 9/2006 | Larue | |
| 2007/0234623 | A1 | 10/2007 | Carney | |
| 2008/0178511 | A1 * | 7/2008 | Storch et al. | 42/90 |
| 2010/0031553 | A1 * | 2/2010 | Couture et al. | 42/90 |

OTHER PUBLICATIONS

TM 9-4931-710-14&P, Technical Manual, Operator, Organizational, Direct Support and General Support Maintenance Manual, Headquarters, Department of the Army. Aug. 1986.

A.R.M.S. Mount Safety Latch, PentagonLight, pp. 1-2, Dec. 6, 2007, "www.pentagonlight.com/item_detail.cfm_id.444".

* cited by examiner

QUICK DETACH MOUNT WITH LATCHING ASSEMBLY

CROSS-REFERENCE TO RELATED APPLICATIONS

This application is related to and claims priority from earlier filed U.S. Provisional Patent Application No. 60/909,956, filed Apr. 4, 2007.

BACKGROUND OF THE INVENTION

The present invention relates generally to quick detach mounting assemblies for combat weapons such as the modular integrated accessory systems found on most modern combat weapons. More specifically, the present invention relates to a quick detach mounting assembly including a latching assembly that prevents accidental rotation of the actuator arm when the mounting assembly is installed onto the weapon.

As the field of combat and commercial weaponry expands, numerous add-on enhancements have become available for attachment to standard firearms, thereby significantly upgrading the capability of the firearm. Of particular interest in the area of combat weapons is the well-known M16/M4 weapon system (M16 and M4 are trademarks of Colt Defense, Inc.). The M16 has been in service for a number of years and will continue to be a popular rifle both in U.S. and foreign militaries for the foreseeable future. Generally, the M16/M4 weapon 2, as depicted in FIG. 1, includes a lower receiver 4, upper receiver 6, butt stock 8, and barrel 10.

The newer models of the M16/M4 weapons further include a mil-std 1913 dovetail rail 12 extending along the top of the upper receiver. These configurations are generally referred to as flat-top receivers. This integrated receiver rail 12 provides a convenient mounting point for many types of enhancement devices such as scopes and other sighting devices. However, space on the upper receiver rail 12 is limited, and many military personnel often have multiple sighting devices that are each tailored to perform in different combat situations. In addition, there are a variety of lighting devices, handgrips, etc. that could also be attached to the weapon for enhanced use of the weapon. The difficulty is that there is simply not enough space on the integrated rail provided on the upper receiver to accommodate all of the desired accessories. Accordingly, the increasing development and refinement of laser sights, infrared lighting, visible lighting, night vision, and specialized scopes and magnifiers, and other accessories continues to drive the need for versatile and reliable integration systems that include additional mil-std 1913 dovetail rails positioned above or around the barrel of the weapon that can support this important equipment and yet stand the test of rugged military use and abuse.

Responding to this need, the applicant has developed a modular integrated rail system (A.R.M.S.® S.I.R.® system), which has been well received by the military and has become popular with several branches of the military (See FIG. 2) (A.R.M.S.® and S.I.R.® are registered trademarks of Atlantic Research Marketing Systems, Inc.). The A.R.M.S. S.I.R. system is fully described in U.S. Pat. No. 6,490,822, the entire contents of which are incorporated herein by reference. These modular integrated rail systems for combat weapons 2 generally include an upper hand guard 14, a means 16 for securing the upper hand guard 14 to the weapon 2, a lower firearm accessory 18 (in most cases this is a lower hand guard), various optional rail segments, and in many cases, a sling swivel 20 for attaching a shoulder sling to carry the weapon 2.

The upper hand guard 14 is the main structural element of the system. The upper hand guard is 14 generally semi-cylindrical in shape and has a forward end and a rearward end and a mil-std 1913 dovetail rail 22 extending longitudinally between the forward end and the rearward end. The semi-cylindrical upper hand guard 14 further includes symmetrically opposing side walls that extend outwardly and downwardly from the dovetail rail and terminate in symmetrically opposing longitudinally extending mounting channels. The mounting channels are used to mount various accessories, such as a lower hand guard 18 or a grenade launcher, to the upper hand guard 14.

An interface means 16 is provided at the rearward end of the upper hand guard 14 to removably secure the upper hand guard 14 to the firearm 2. In the original S.I.R. system as shown in U.S. Pat. No. 6,490,822, the clamp is an elongated clamping rail that secures the upper hand guard 14 to the dovetail rail 12 on the top of the upper receiver 6 of the weapon 2. In the newer S.I.R. systems, the interface means is a U-shaped yoke or clamp that secures the upper hand guard 14 directly to the barrel nut.

As is well known in this area, field modification of weapons is critical in combat situations. For example, it may be desired to swap the lower hand guard for a grenade launcher, which can be attached to the upper hand guard, or to add an optional rail segment for securing an added accessory. Similarly, there may be a desire to exchange various different sights or lighting accessories that are mounted on the various dovetail rails positioned around the weapon. In this regard standardized mounting assemblies have been developed to allow quick and easy removal and mounting of these devices relative to the dovetail rails. Such an attachment device was disclosed in U.S. Pat. No. 5,276,988, issued on Jan. 11, 1994 to the present applicant, the contents of the '988 patent being incorporated herein by reference. Generally, the prior art attachment assemblies included a main body having a lower portion that is configured to engage the dovetail rail found on most modern combat weapons and an upper portion that can take on a variety of configurations depending on the accessory that is to be mounted thereon. The lower portion of the mounting assembly has a first engagement member extending downwardly along one side thereof for engaging one side of the dovetail rail. Further, a boss formation is provided adjacent the side of the main body to receive a clamping assembly that is particularly suited to be releasably engagable with a second side of the dovetail rail such that the clamping assembly cooperates with the first engagement member to retain the modular mounting assembly in its installed position on the dovetail rail.

One difficulty with the prior art attachment assemblies is that the potential exists for accidental operation (rotation) of the actuator arm resulting in dislodgement of the mount (and the attached accessory) from the weapon. For example, the potential existing for the actuator arm to become snagged on brush or branches during operations in heavily wooded or jungle areas, and accidentally rotated causing dislodgement of the mounting assembly. While the existing spring tension of the clamping assembly is generally more than adequate to retain the actuator arm in the engaged position, it is critically important that the mount stay on the weapon.

Accordingly, there is a perceived need for an improved quick detach mount that includes a latching assembly that prevents accidental rotation of the actuator arm even under the harshest environmental conditions.

BRIEF SUMMARY OF THE INVENTION

In this regard, the present invention provides for an improved mounting assembly that is configured to be releasably attached to a standard dovetail rail profile and that includes a latching assembly for selectively retaining the actuator arm in the engaged position.

The mounting assembly of the present invention is particularly suited for use in connection with any firearm that utilizes a standard dovetail rail system. The mounting assembly is configured in the same manner as a traditional prior art mounting interface devices and includes a lower clamping portion that engages the dovetail rail found on most modern combat weapons and an upper accessory interface portion that can take a variety of configurations depending on the accessory that is to be mounted thereon.

The mounting assembly includes a mount body and a boss formation that extends from one side thereof. A clamping assembly that includes a camming member having a foot and a shaft extending upwardly therefrom is installed into the boss formation such that the foot of the camming member is received in a position adjacent the bottom of the mounting assembly body and the shaft extends upwardly through the boss formation. An actuator arm is installed onto the top end of the shaft adjacent the top of the boss formation in a manner that engages the shaft and provides a means for the user to rotate the shaft and the foot such that the foot can be engaged and disengaged with the dovetail rail to hold the mounting assembly on the dovetail rail.

The mount further includes a latching assembly for selectively retaining the actuator arm in the engaged position. The latching assembly comprises a latch body, a spring and a captivating screw with a head. The latch body includes a seat on one end for receiving the elbow of the actuator arm, and an actuator post on the other end. The actuator post extends upwardly through a guide hole in the body of the mount adjacent the actuator arm and is slidably movable therein between an upper engaged position and a lower disengaged position. The spring is received over the exposed upper end of the actuator post and the captivating screw is secured to the upper end of the actuator post. The spring is thus captivated between the upper surface of the mount body and the lower shoulder of the head of the captivating screw. The spring normally biases the head of the captivating screw in an upward direction, thus drawing the seat of the latch body upwardly into engagement with the elbow of the actuator arm. A front wall of the seat sits in front of the actuator arm and prevents accidental rotation while engaged. When it is desired to rotate the actuator arm, the operator simply depresses the latch body by pressing down on the head of the captivating screw moving the entire latch body downwardly and disengaging the seat from the elbow of the actuator arm.

Accordingly, it is an object of the present invention to provide an improved mounting assembly that allows for the releasable mounting of various accessories onto the standard dovetail rail found on modern combat weapons.

Further, it is an object of the present invention to provide a mounting assembly that can be reliably mounted onto a dovetail rail while including a spring biased latching assembly for selectively retaining the actuator arm in the engaged position.

These, together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
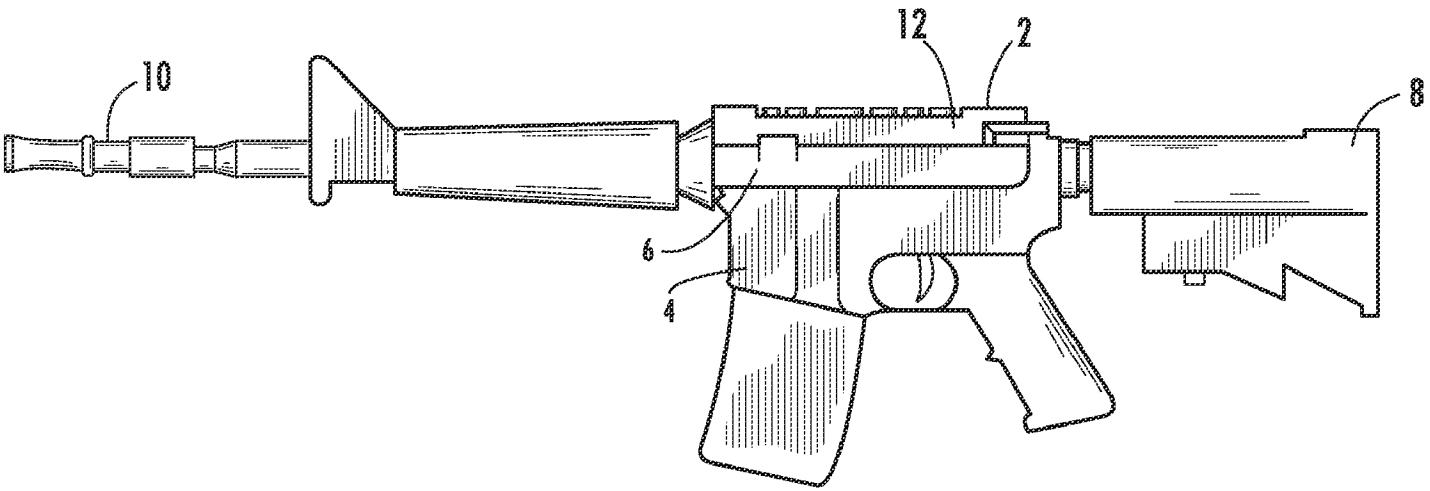
FIG. 1 (PRIOR ART)
FIG. 1 is a side view of a prior art combat firearm.
Figure 2:
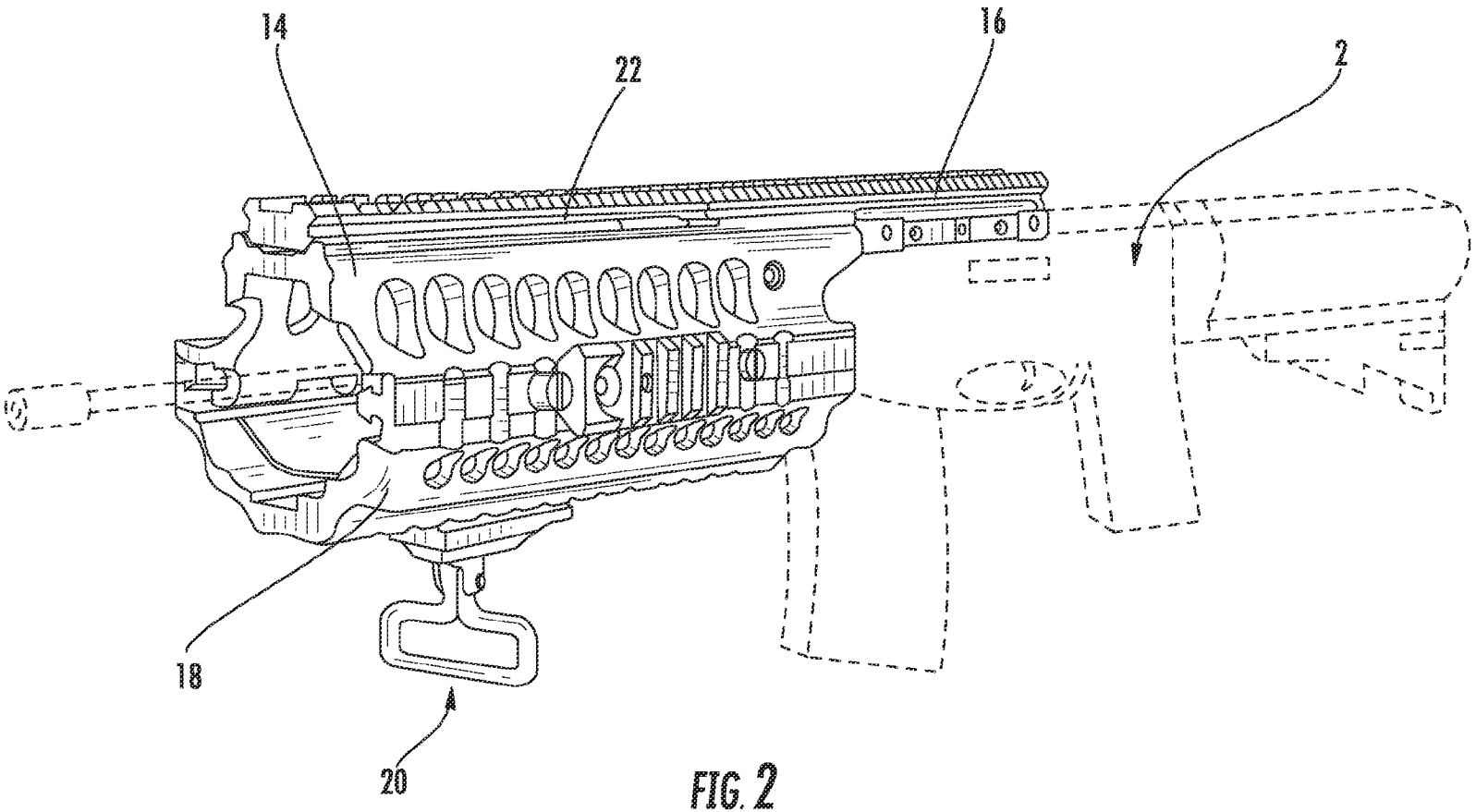
FIG. 2 (PRIOR ART)
FIG. 2 is a perspective view of a prior art rail interface system.

Now referring to the drawings, the mounting assembly is shown and generally illustrated at 30 in FIGS. 3-7. The mounting assembly 30 is configured to be releasably attached to a standard dovetail rail profile 22 as is depicted in FIGS. 1 and 2.

Figure 3:
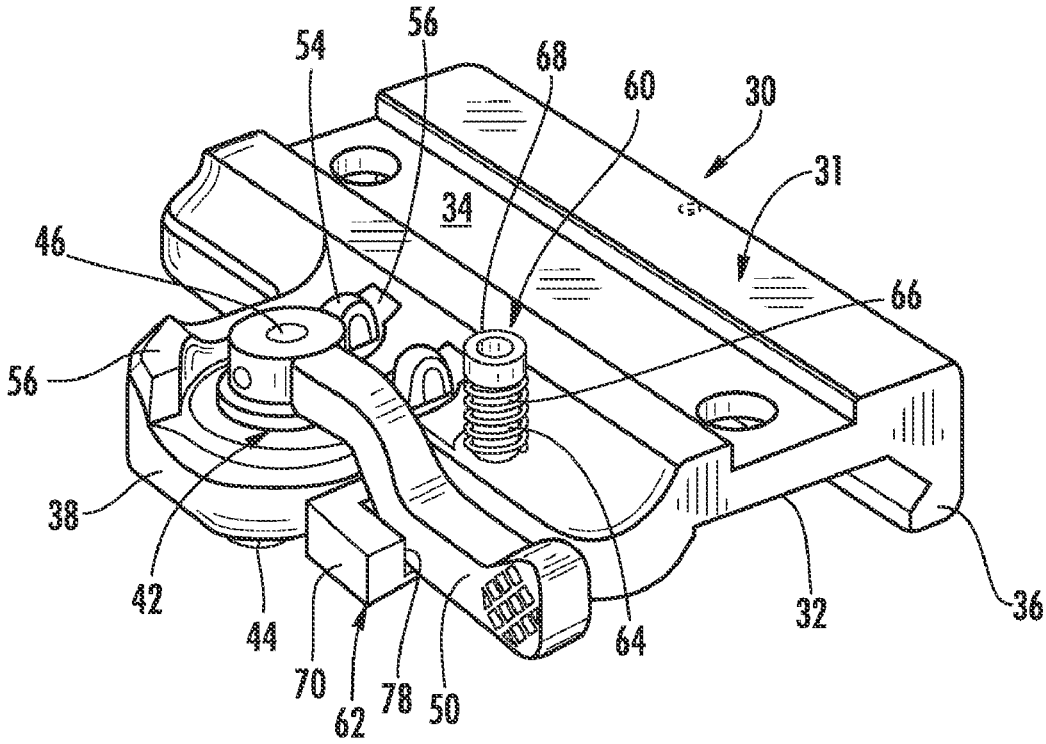
FIG. 3 is a perspective view of the mounting assembly of the present invention.
Figure 4:
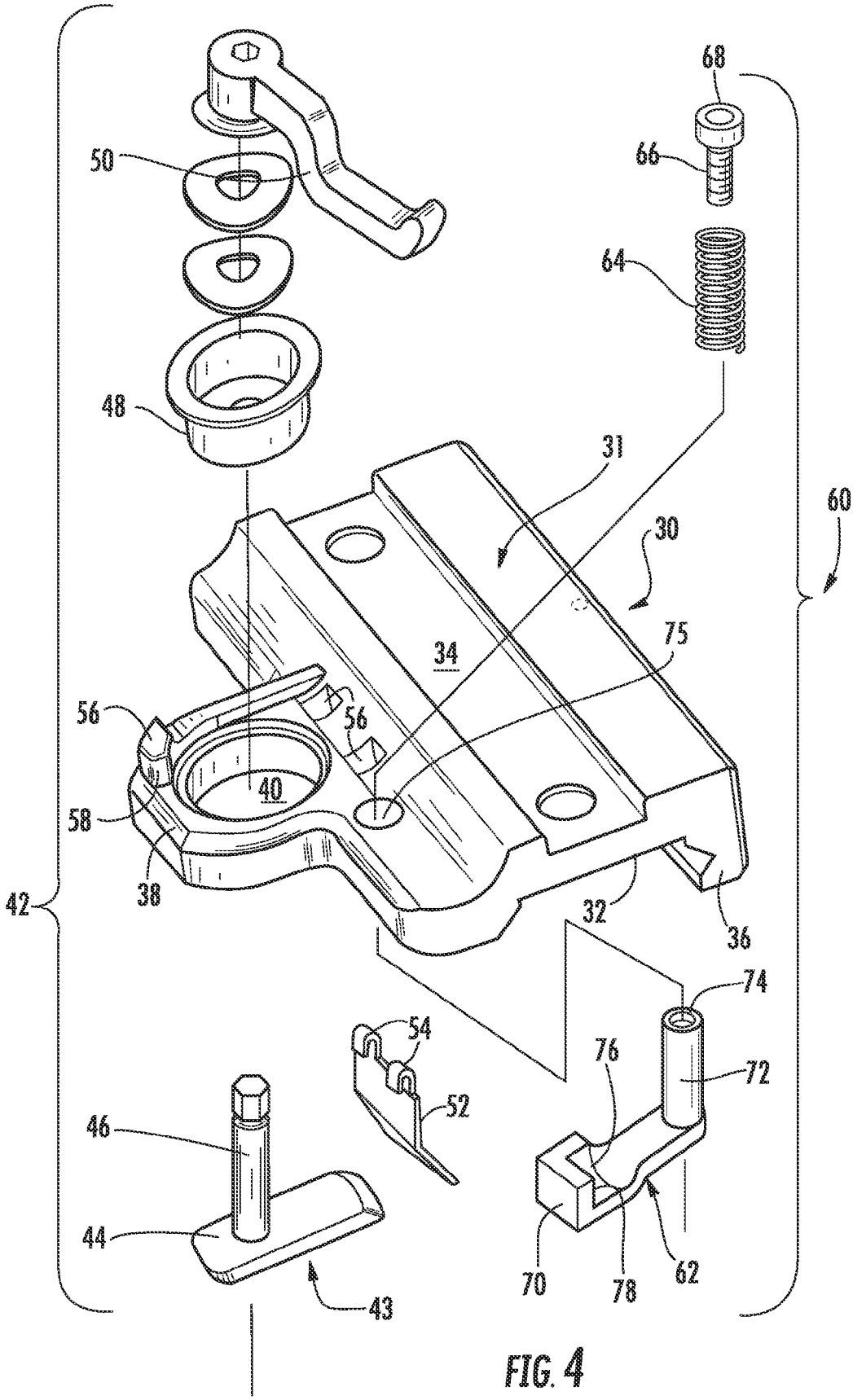
FIG. 4 is an exploded perspective view thereof.
Figure 5:
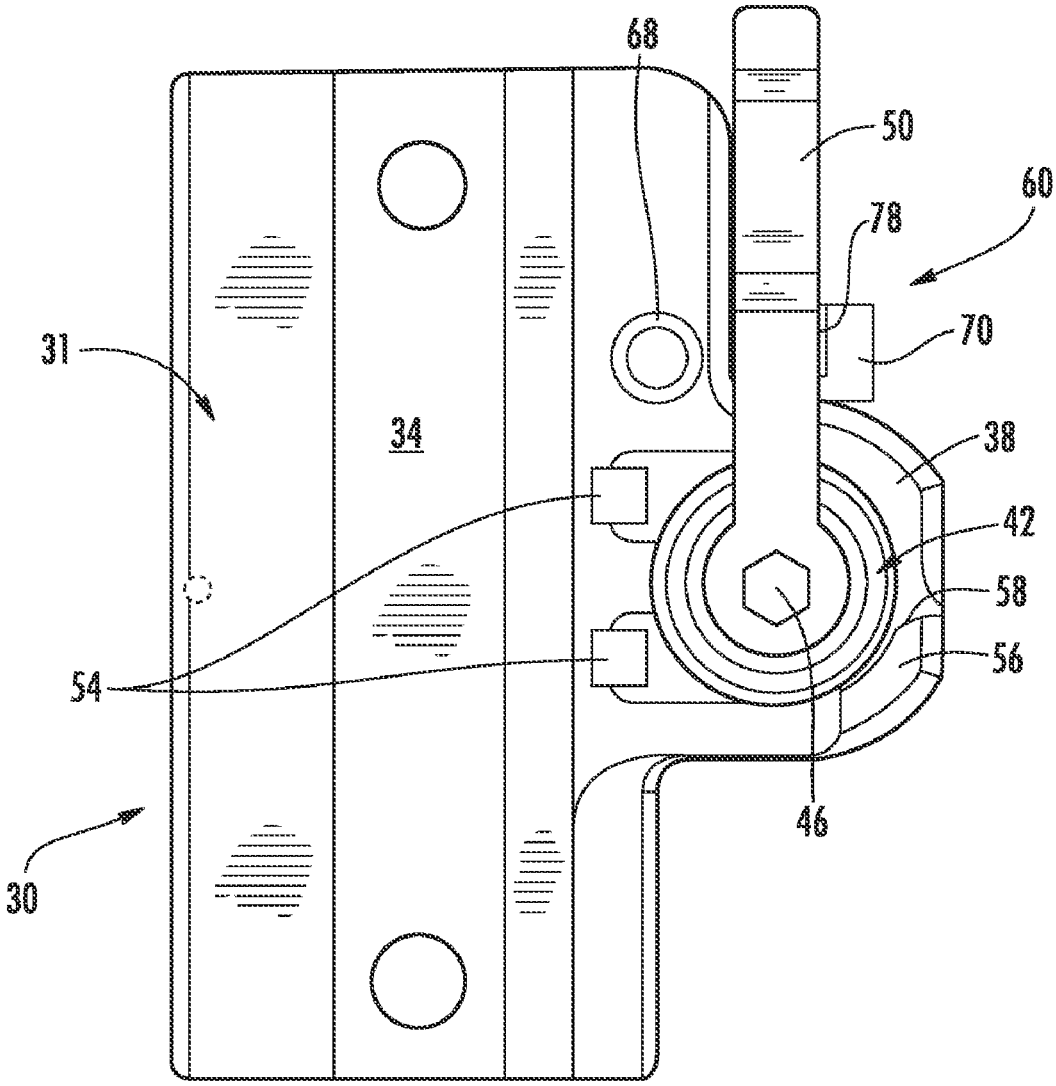
FIG. 5 is a top view thereof with the actuator arm and latching assembly in the engaged position.
Figure 6:
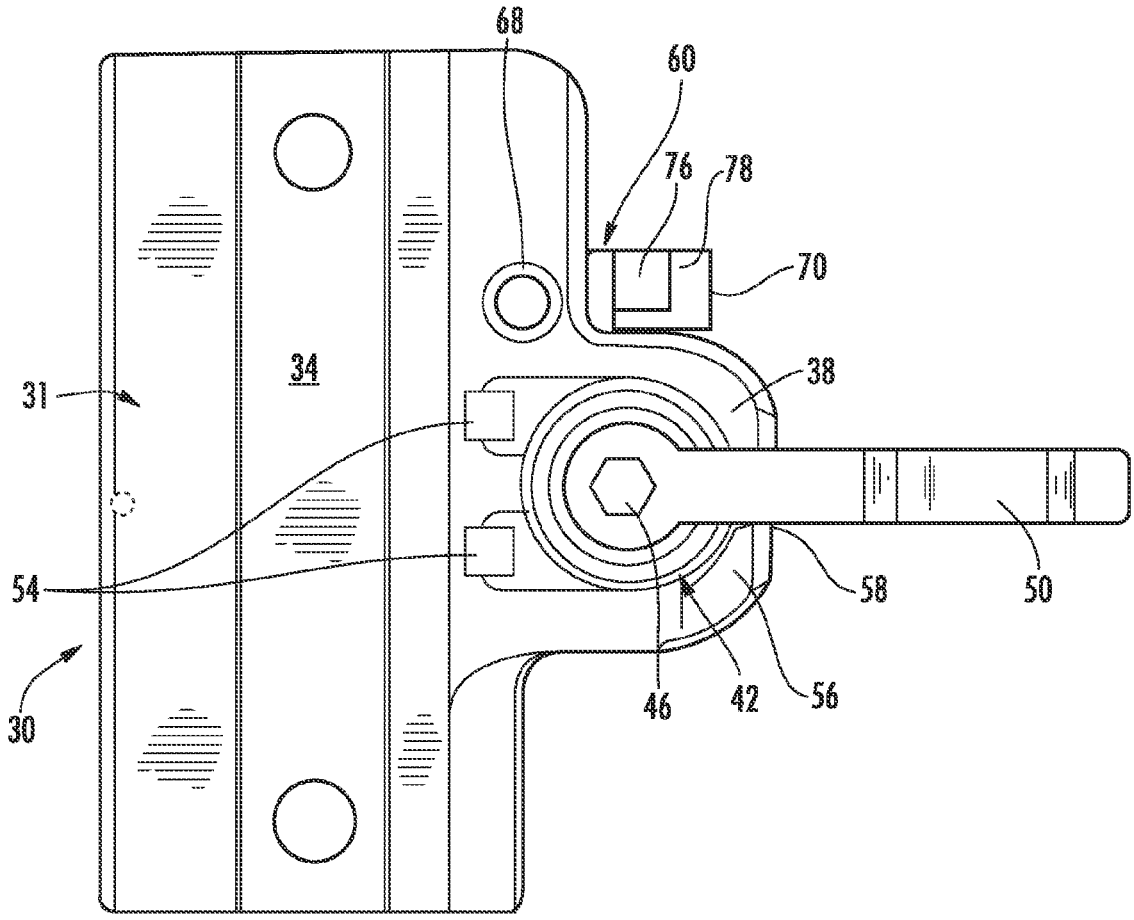
FIG. 6 is a top view thereof with the actuator arm in the disengaged position.
Figure 7:
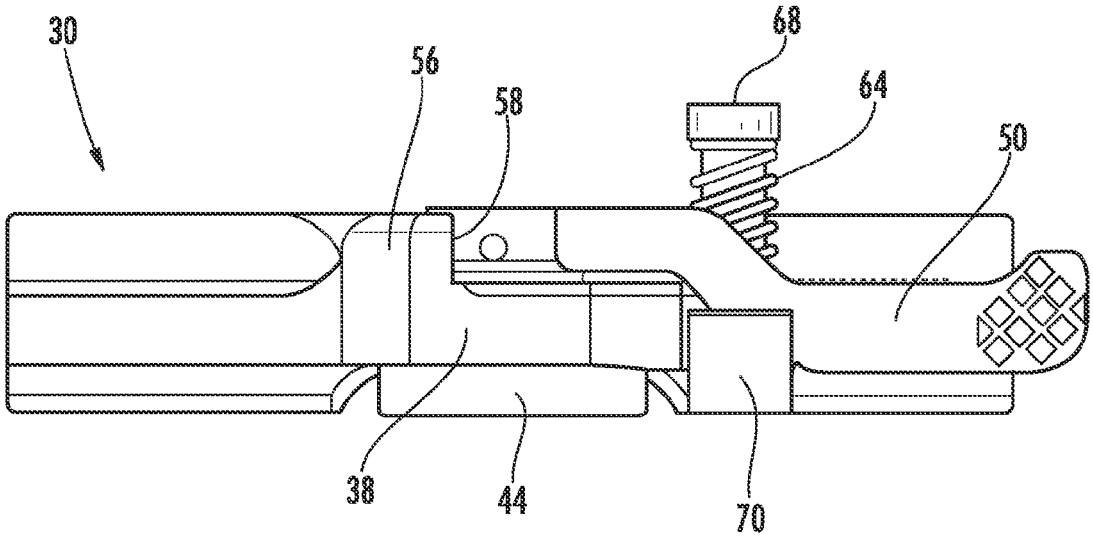
FIG. 7 is a side view thereof with the latching assembly in the engaged position.

Turning now to FIG. 3, as can be seen, the mounting assembly 30 includes a main body 31 that is configured in substantially the same manner as a traditional prior art device and further includes a lower portion 32 that is configured to engage the dovetail rail found on most modern combat weapons and an upper portion 34 that can take on a variety of configurations depending on the accessory that is to be mounted thereon. The lower portion 32 of the mounting assembly has a first engagement member 36 extending downwardly along one side thereof for engaging one side of the dovetail rail. Further, a boss formation 38 is provided adjacent the side of the main body 31 wherein the boss formation 38 includes an opening 40 therein to receive a clamping assembly 42.

The clamping assembly 42 is particularly suited to be releasably engagable with a second side of the dovetail rail such that the clamping assembly 42 cooperates with the first engagement member 36 to retain the modular mounting assembly 30 in its installed position on the dovetail rail. It is preferred that the clamping assembly 42 be rotatably movable between an engaged position wherein the clamping assembly 42 engages the second side of said dovetail rail and cooperates with the first engagement member 36 on the lower portion 32 of the modular mounting assembly 30 to retain the mounting assembly 30 on the dovetail rail, and a disengaged position wherein the clamping assembly 42 is disengaged, thereby allowing the mounting assembly 30 to be removed from the dovetail rail.

In a preferred embodiment the clamping assembly 42 includes a camming member 43 having a foot 44 and a shaft 46 extending upwardly therefrom such that the shaft 46 is installed into the opening 40 in the boss formation 38 on the mounting assembly 30. Further, to enhance the overall fit and rotation of the clamping assembly 42, a bushing 48 may also be provided in the opening 40 between the boss formation 38 and the shaft 46. Once the shaft 46 is inserted into the opening 40 in the boss formation 38, the foot 44 is received in a position adjacent the bottom surface of both the boss formation 38 and the mounting assembly 38 itself. An actuator arm 50 is installed onto the top end of the shaft 46 and is received adjacent the top of the mounting assembly 30. The actuator arm 50 engages the shaft 46 and provides a means for the user to rotate the shaft 46 and the foot 44 allowing the foot 44 to be engaged and disengaged with the second side of the dovetail rail. In this manner, the clamping assembly 42 and the first engagement member 36 cooperate to hold the mounting assembly on the dovetail rail.

There is also shown generally a buffer element 52 having a flat horizontal base portion with an arm 54 at each end of the base extending upwardly at an oblique angle of 135 degrees. The free end of each arm is curved approximately 150 degrees. Two side-by-side openings 56, corresponding in separation to the separation between buffer element 52 arms 54, are formed in the mounting assembly 30. The arms 54 on the top of the buffer element 52 are slid through the openings 56 thereby retaining the buffer element 52 in the mounting assembly 30. In this arrangement, the buffer element 52 is positioned between the surface of the dovetail rail and the foot 44 of the clamping assembly 42. Rotation of the actuator arm 50, the shaft 46 and in turn the foot 44 serves to press the buffer element 52 into the side of the dovetail rail. By placing the buffer element 52 in this position, the buffer element 52 prevents the foot 44 from directly touching and thereby scratching the dovetail rail. The buffer element 52 further distributes the clamping pressure over a greater area and prevents distortion of the aluminum dovetail rail 22.

An indexing shoulder formation 56 is provided on the boss formation 38. The shoulder 56 extends upwardly from the boss formation 38 and is positioned in such a manner that the shoulder 56 prevents over rotation of the actuator arm 50. The front face 58 of the shoulder 56 acts as a positive stop for the actuator arm 50 once it reaches the fully open/disengaged position (See FIG. 6). The shoulder 56 is illustrated as being a monolithically formed component that is milled integrally with the boss 38. It should be appreciated by one skilled in the art that the shoulder 56 may also be formed by installing a separately machined object such as a pin, a wedge, a block or the like onto the boss 38 to prevent further rotation of the actuator 50 past a fully disengaged position.

The mount 30 further includes a latching assembly generally indicated at 60 for selectively retaining the actuator arm 50 in the engaged position. The latching assembly 60 comprises a latch body 62, a spring 64 and a captivating screw 66 with a head 68.

Figure 8:
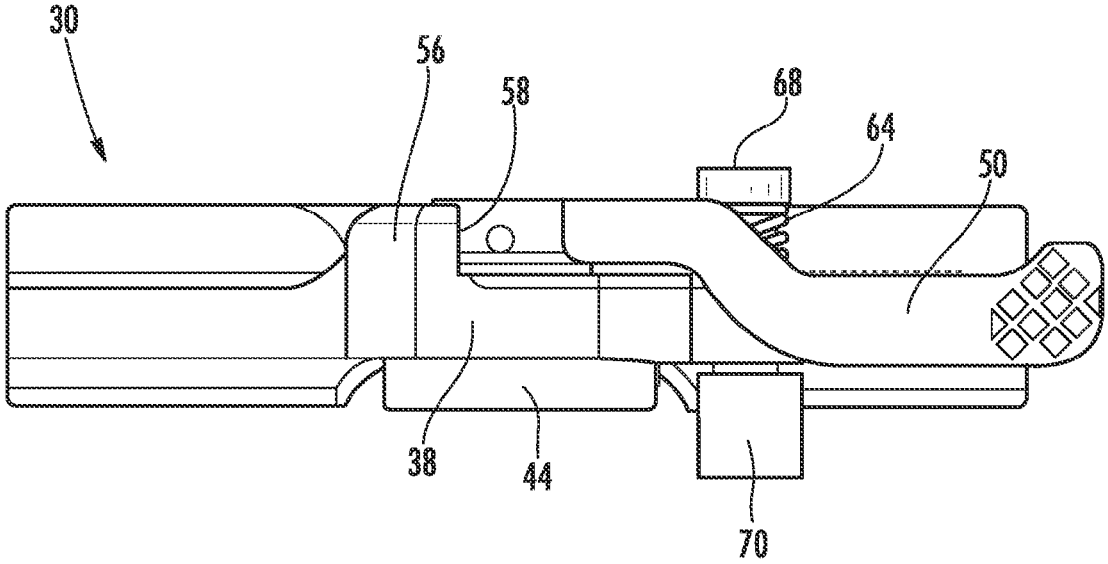
FIG. 8 is a side view thereof with the latching assembly in the disengaged position to allow rotation of the actuator arm.

The latch body 62 includes a seat 70 on one end for receiving the elbow portion or forearm portion of the actuator arm 50, and an actuator post 72 on the other end. The actuator post 72 extends upwardly through a guide hole 75 (FIG. 4) in the body 31 of the mount adjacent the actuator arm 50 and is slidably movable therein between an upper engaged position (FIGS. 1, 5, 6, and 7) and a lower disengaged position (FIG. 8). The spring 64 is received over the exposed upper end of the actuator post 72 and the captivating screw 66 is secured to the upper end of the actuator post 72. The threaded shaft of the captivating screw 66 is received into a threaded opening 74 in the end of the actuator post 72. The spring 64 is thus captivated between the upper surface of the mount body 31 and the lower shoulder of the head 68 of the captivating screw 66. The spring 64 normally biases the head 68 of the captivating screw 66 in an upward direction, thus drawing the seat 70 of the latch body 62 upwardly into engagement with the elbow of the actuator arm 50. The seat portion 70 includes a contoured surface 76, which conforms to the curved elbow portion of the actuator arm 50. A front wall 78 of the seat 70 sits in front of the actuator arm 50 and prevents accidental rotation while engaged. When it is desired to rotate the actuator arm 50, the operator simply depresses the latch body 62 by pressing down on the head 68 of the captivating screw 66 moving the entire latch body 62 downwardly and disengaging the seat from the elbow of the actuator arm (FIG. 8). When the latch body 62 is in the lower position (FIG. 8) the actuator arm is free to rotate into its own disengaged position.

Accordingly, it can be seen that the present invention provides a unique and novel modular accessory mount that fills a critical need for soldiers in the field by ensuring positive and reliable operation. The latching assembly 60 provides a simple solution, which can prevent accidental loss of critical equipment in the field. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A mounting assembly for attaching an accessory to a dovetail rail interface on a firearm, said mounting assembly comprising:

a mount body having a lower portion and an upper portion, said lower portion configured to engage a first side of said dovetail rail, said upper portion configured to receive and retain an accessory;

a boss formation extending from a side of said mount body;

a clamping assembly received within an opening in said boss formation, said clamping assembly including a camming foot positioned adjacent a bottom surface of said boss formation, a shaft extending upwardly from said camming foot, said shaft extending through an opening in said boss formation; and an actuator arm positioned adjacent said top surface of said boss formation and affixed to said shaft such that rotation of said actuator arm causes rotation of said shaft and said camming foot, said actuator arm being rotatably movable between an engaged position wherein said camming foot engages a second side of said dovetail rail to retain said mounting assembly on said dovetail rail and a disengaged position wherein said camming foot is disengaged from said second side of said dovetail rail thereby allowing said mounting assembly to be removed from said dovetail rail; and a latching assembly configured and arranged for selectively retaining said clamping assembly in said engaged position, said latching assembly including a latch body configured and arranged with a seat on a first end and an actuator post on a second end, said actuator post being slidably received through a guide hole in said mount body adjacent to said boss formation, said latch body being movable between an engaged position, where said seat engages said actuator arm, and a disengaged position wherein said seat is disengaged from said actuator arm, a captivating head on said actuator post, and a spring captivated between said mount body and said captivating head, said spring normally biasing said latch body to said engaged position.

2. The modular mounting assembly of claim 1, wherein said actuator arm is substantially parallel to said mounting assembly body when said clamping assembly is in said engaged position.

3. The modular mounting assembly of claim 1, wherein said actuator arm is substantially perpendicular to said mounting assembly body when said clamping assembly is in said disengaged position.

4. The modular mounting assembly of claim 1, said clamping assembly further comprising:

a buffer pad pivotally attached adjacent bottom surface of said boss formation and adjacent said camming foot, wherein rotation of said camming foot causes said buffer pad to become engaged against said second side of said dovetail rail between said camming foot and said dovetail rail.

5. The modular mounting assembly of claim 1, said clamping assembly further comprising:

a bushing received within said opening in said boss formation and around said clamping assembly shaft.

6. The modular mounting assembly of claim 2, wherein said actuator arm is substantially perpendicular to said mounting assembly body when said clamping assembly is in said disengaged position.

7. The modular mounting assembly of claim 2, said clamping assembly further comprising:

a buffer pad pivotally attached adjacent bottom surface of said boss formation and adjacent said camming foot, wherein rotation of said camming foot causes said buffer pad to become engaged against said second side of said dovetail rail between said camming foot and said dovetail rail.

8. The modular mounting assembly of claim 2, said clamping assembly further comprising:

a bushing received within said opening in said boss formation and around said clamping assembly shaft.

9. The modular mounting assembly of claim 3, said clamping assembly further comprising:

a buffer pad pivotally attached adjacent bottom surface of said boss formation and adjacent said camming foot, wherein rotation of said camming foot causes said buffer pad to become engaged against said second side of said dovetail rail between said camming foot and said dovetail rail.

10. The modular mounting assembly of claim 3, said clamping assembly further comprising:

a bushing received within said opening in said boss formation and around said clamping assembly shaft.

11. The modular mounting assembly of claim 4, said clamping assembly further comprising:

a bushing received within said opening in said boss formation and around said clamping assembly shaft.

* * * * *